United States Patent [19]

Hinds

[11] 4,316,610

[45] Feb. 23, 1982

[54] SEGMENTED ELASTIC CABLE EXERCISER BAR

[76] Inventor: Robert S. Hinds, 1803 Regent St., Madison, Wis. 53705

[21] Appl. No.: 95,664

[22] Filed: Nov. 19, 1979

Related U.S. Application Data

[63] Continuation-in-part of Ser. No. 755,552, Dec. 30, 1976, Pat. No. 4,195,835.

[51] Int. Cl.[3] ..... A63B 21/02

[52] U.S. Cl. ..... 272/137; 272/143; 272/DIG. 4

[58] Field of Search ..... 272/139, 137, 134, 135, 272/142, 117, 118, 143; 88/65; 182/5, 10; 224/57; 145/61 R; 30/340; 46/16

[56] References Cited

U.S. PATENT DOCUMENTS

| | | | |
|---|---|---|---|
| 391,896 | 10/1888 | Hill | 224/57 |
| 1,364,552 | 1/1921 | Hill | 30/340 X UX |
| 2,679,272 | 5/1954 | Giannone | 145/61 R X |

FOREIGN PATENT DOCUMENTS

| | | | |
|---|---|---|---|
| 9327 | 11/1894 | Switzerland | 272/79 A |

*Primary Examiner*—William R. Browne
*Attorney, Agent, or Firm*—Keith Schoff

[57] ABSTRACT

An improved bar for elastic cable exercise devices is disclosed, the bar being segmented for disassembly into pieces of a size which may be easily transported in a valise or other small case for the convenience of travelers and commuters, the bar in an assembled state being grooved and bifurcated at the ends for engaging and guiding cable which, when the bar is rotated during use, is wound on the bar.

4 Claims, 18 Drawing Figures

Fig. 8.
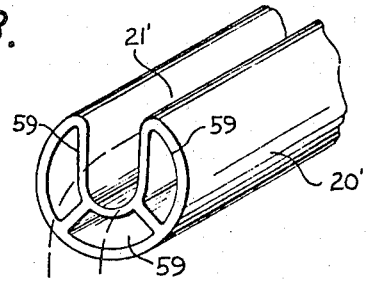
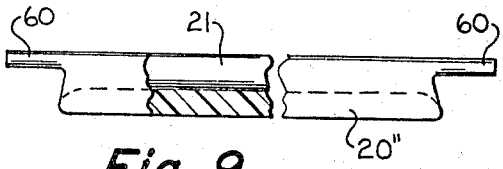
Fig. 9.
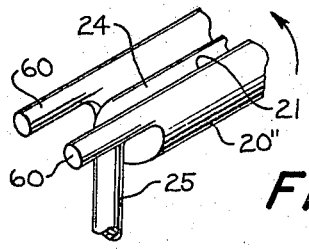
Fig. 10.
Fig. 11.
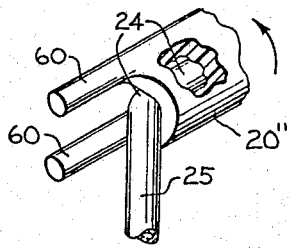
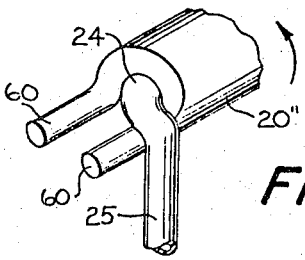
Fig. 12.
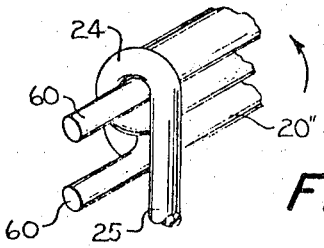
Fig. 13.
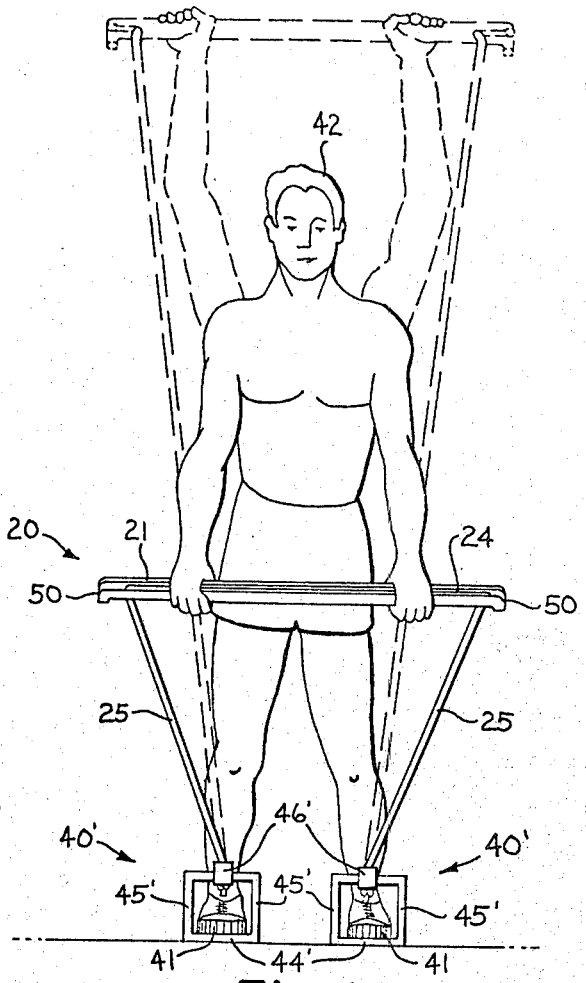
Fig. 14.
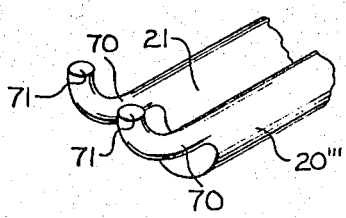
Fig. 15.
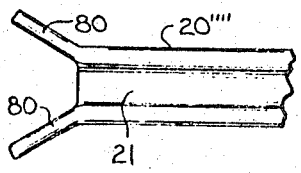
Fig. 16.

SEGMENTED ELASTIC CABLE EXERCISER BAR

This application is a continuation-in-part of Ser. No. 755,552 filed Dec. 30, 1976, now U.S. Pat. No. 4,195,835.

FIELD

This invention relates to an exercising device comprising an elastic cable and more particularly to such a device comprising a bar which is generally held in a substantially horizontal position and is engaged with the cable.

PRIOR ART

An exercising device comprising an elastic cable is described in U.S. Pat. No. 61,702 issued in 1867 and a horizontal bar engaged with a cable is disclosed therein. However, only one run of cable attached to the bar at the center of the bar is provided. Many similar devices in which a single run of elastic cable is attached to the center of a horizontal bar have been subsequently described. Later patents have described exercising devices comprising elastic cable in which a bar may be held horizontally with both hands of a user and a downward run of cable is provided at each end of the bar. An example is U.S. Pat. No. 3,265,015.

U.S. Pat. Nos. 3,117,781 and 3,785,644 show winding of a rope or cord at each end of a bar but the rope or cord is non-elastic.

No patent is known in which a grooved bar or a bar with the herein described finger-like projections at each end is disclosed, either unitary or segmented.

SUMMARY

As part of an exercising device comprising an elastic cable, a bar is provided which may generally be held horizontally in both hands of the user and may engage with a cable to provide a downward run of the cable at each end of the bar. The bar is provided with a groove, extending from one end to the other, to receive the cable and finger-like projecting members are provided extending respectively from each side of the groove at each end of the bar to cause the cable to be retained in the groove when the bar is rotated through 180 degrees and ten to cause the cable to be wound on the bar as the bar is further rotated. The finger-like projecting members may extend directly longitudinally outward from the end of the bar or may extend divergently outward or may extend outwardly and thence downwardly (preferred) or extend outwardly and thence upwardly. In a preferred embodiment, the bar is segmented to be severable into lengths which are conveniently accomodated in a valise or overnight carrying case so that the exercise device may be easily transported by a traveler or commuter for use when away from home. For providing strength and rigidity to a segmented bar, it is preferred to increase the cross sectional area of the bar near the joints between segments and to provide bayonet type locking pin and sleeve couplings between segments and providing such couplings in pairs at each joint to prevent one bar segment from being rotated with respect to another around the pin. Spring loaded detents positioned to engage a lip or opening in the sleeve member of a coupling retains the segments in tightly abutting contact while enabling the segments to be separated by pulling axially along the bar with manual force to open the joint.

By suitably securing the cable at one end of the bar, the bar may be utilized to simulate the handle of a golf club, canoe paddle, hockey stick, tennis racket, baseball bat or a variety of similar motions used with devices of the like, and by making motions which simulate the use of such objects in the sports with which they are respectively associated, muscles used in these sports may be exercised.

OBJECTS

It is therefore an object of the invention to provide an improved bar in an elastic cable exercising device.

Another object is to provide such a bar which may be readily engaged and disengaged with the elastic cable used in such a device and which at the same time may be used in many exercises without disengagement of the cable from the bar.

Other objects will become apparent from the drawings and from the following detailed description in which it is intended to illustrate the applicability of the invention without thereby limiting its scope to less than that of all equivalents which will be apparent to one skilled in the art.

DRAWINGS

In the drawings like reference numerals refer to like parts and:

FIG. 8 is a perspective fragmentary view of one end of a bar which is a modification of the embodiment of FIGS. 1, 2, 3, 4 and 5;

FIG. 9 is a side elevation of a modification of the bar of FIG. 1;

FIG. 10 is a fragmentary perspective view of one end of the bar of FIG. 9 showing an elastic cable in conjunction therewith;

FIG. 11 is a view corresponding to that of FIG. 10 wherein the bar has been rotated through approximately 90°;

Figure 1:
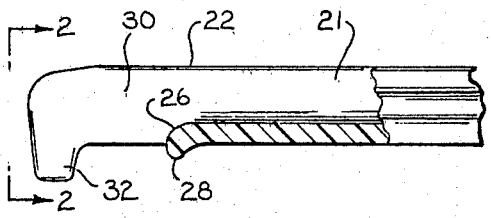
FIG. 1 is a partially cutaway elevation of a preferred embodiment of the bar in accordance with the invention.
Figure 1:
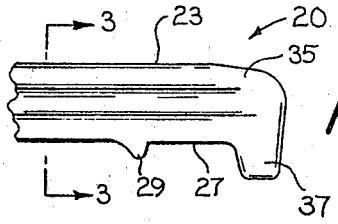

FIG. 12 is a view corresponding to that of FIGS. 10 and 11 wherein the bar has been rotated approximately 180° from the position shown in FIG. 10 and approximately 90° from the position shown in FIG. 11;

FIG. 13 is a view corresponding to that of FIGS. 10, 11 and 12 wherein the bar has been rotated approximately an additional 90° from the position shown in FIG. 12;

FIG. 14 is a front elevation of the bar being utilized in an exercise;

FIG. 15 is a fragmentary perspective view of one end of a bar which is a modification of the embodiment of FIG. 9 and also a modification of the embodiment of FIG. 1; and FIG. 16 is a fragmentary plan view of one end of a bar which constitutes a modification of the embodiment of FIG. 9.

Figure 17:
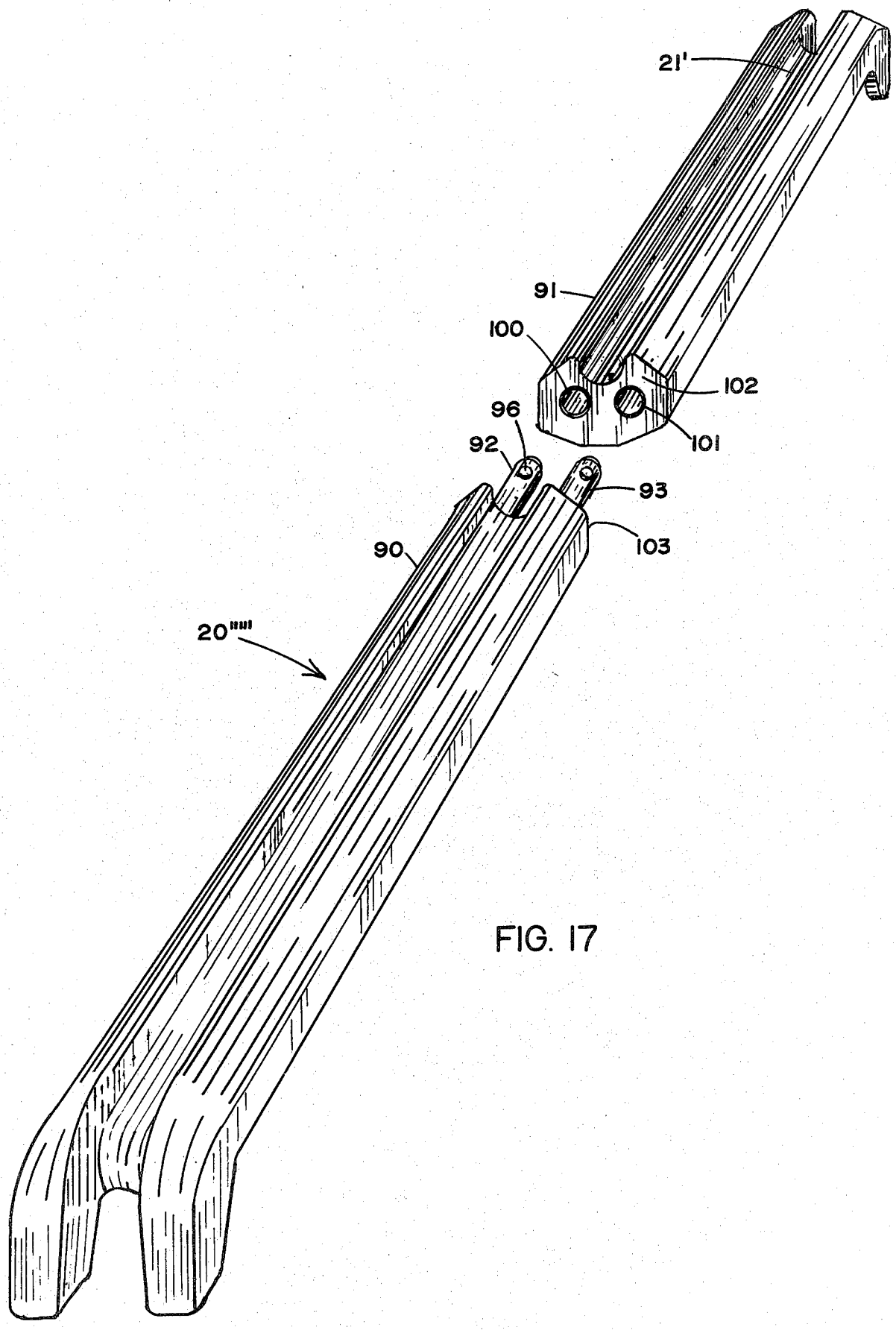
Figure 18:
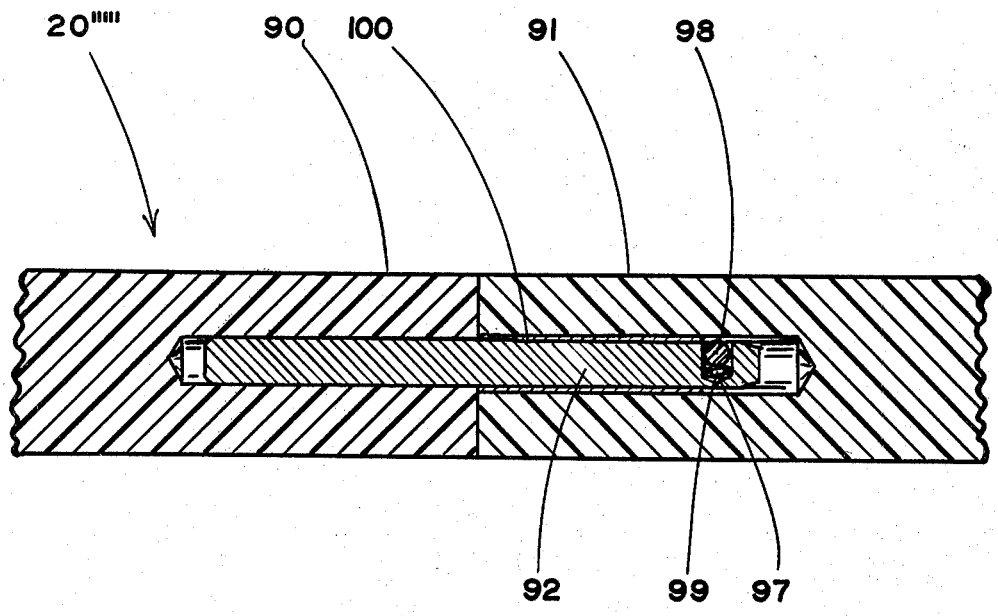

FIG. 17 is a perspective view of an embodiment of a segmented bar of this invention shown with the segments separated and disassembled;

FIG. 18 is a cross-sectional elevation of a portion of the embodiment of FIG. 17 shown with the segments assembled.

DESCRIPTION

Reference is made herein to an elastic cable. It is understood that that term "elastic" may be accurately applied to a steel bar, a wooden board or in a broad sense nearly any solid object in referring to the tendency or ability of such object to return to its original position (when stress is released) after it has been strained by applying a stress to it. Further reference is made herein to a bar, and it is understood that the word "bar" as used herein means an elongated lever-like means having considerable rigidity. However, the term "elastic" is used herein throughout in the well known sense of referring to an object typified by a rubber band, piece of shock cord or a length of surgical tubing which may consist of or comprise either a natural or synthetic elastomer material, for example, natural rubber or a copolymer of butadience and styrene. Objects referred to herein by use of the term "elastic" are characterized by returning to their original shape after having been deformed greatly. Thus, an "elastic" (as the term is used herein) cord or cable may be stretched to several times it original length by imposition of a suitable force and will return almost immediately to its original length when the force ceases to be imposed.

Figure 2:
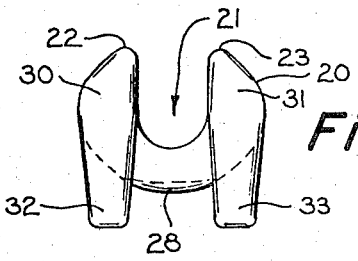
FIG. 2 is an end elevation taken on lines 2—2 in FIG. 1.
Figure 3:
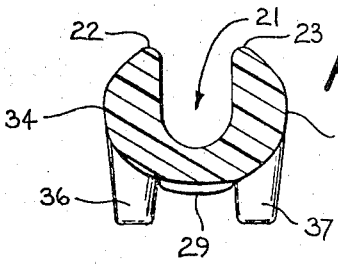
FIG. 3 is a cross-sectional view taken on lines 3—3 in FIG. 1.

Referring now to FIGS. 1, 2 and 3, bar 20 may be provided with groove 21 which may have two upper edges 22 and 23 which together may be said to constitute the upper surface of the bar so that groove 21 may be said to be a groove in the upper surface of the bar. Elastic cable 24 (FIGS. 4, 5 and 14) may be received in groove 21, adjacent respective ends of the bar. Downwardly extending projections 28 and 29 may be provided at ends of groove 21 at points 26 and 27 to provide relatively generally rounded extended surfaces over which the cable may pass at each end of groove 21 rather than passing over a relatively sharp edge. At one end of bar 20 there may be provided a first pair of finger-like members adjacent point 26 which may extend longitudinally outward on each side of groove 21 as indicated at 30 and 31 and thence may extend downwardly as indicated at 30 and 31 and thence may extend downwardly as indicated at 32 and 33 and at the other end of the bar adjacent point 27 a like pair of finger-like members may be provided which may extend longitudinally outward on each side of the groove as indicated at 34 and 35 and thence may extend downwardly as indicated at 36 and 37. As used herein the term "pairs of finger-like member" will be understood to mean a bifurcation with two protruding elements as shown in the drawings.

Figure 4:
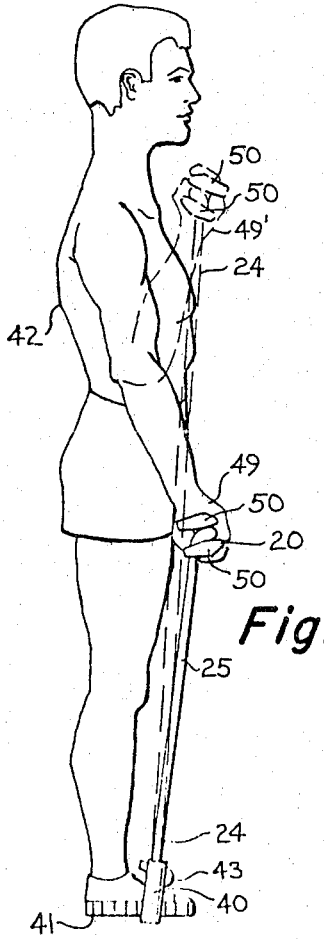
FIG. 4 is a side elevation of the bar being utilized in an exercise.

Referring now to FIG. 4, foot engaging members 40 which may also be used as hand grip members are shown engaged with the feet 41 of a user 42 and have the ends of cable 24 attached thereto at 43.

Figure 6:
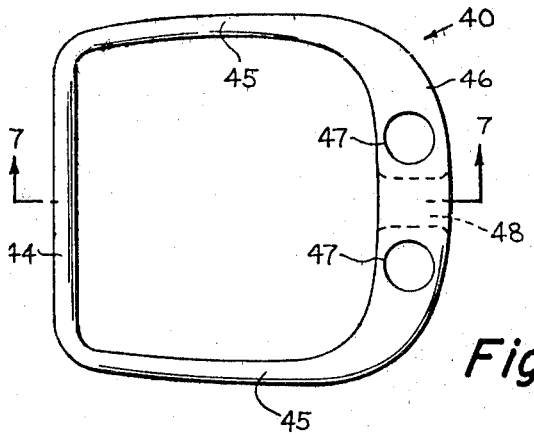
FIG. 6 is a plan view of a grip member which may be engaged with a foot as shown in FIG. 4.
Figure 7:
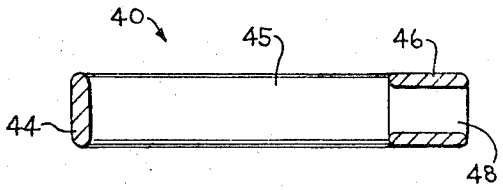
FIG. 7 is a cross-sectional view taken on lines 7—7 in FIG. 6.

An embodiment of member 40 (as shown in greater detail in FIGS. 6 and 7) may comprise a laterally extending "thread" portion 44 which may have two side portions 45 extending upwardly therefrom to a cable-attachment portion 46. Portion 46 may have holes 47 laterally received therein and hole 48 longitudinally received therein, in perpendicular relation to tread portion 44. Cable 24 may be attached thereto by first passing the cable through any one of three holes and thence through any other but is preferably attached by first passing it through hole 48 and thence through one of holes 47 as indicated at 43 of FIG. 4. Security of attachment may be increased by passing the free end of the cable (after passing it through one of holes 47) under the bight then formed between hole 48 and that one of holes 47 through which it has been passed.

In FIG. 14, feet 41 of user 42 may be engaged with modifications 40' of members 40. Members 40' may be square in form as shown, having relatively straight side portions 45' integrally attached to cable-attachment portions 46' and relatively straight tread portions 44'.

Run 25 of a cable extending downwardly from an end of bar 20 may thus be effectively attached to one of feet 41 of user 42 as shown in FIGS. 4 and 14. When the user's hands are in the position shown in full lines in FIG. 4 (at 49) or in FIG. 14 the bar is tilted as shown and cable 24 instead of slipping loose from one end or the other or both ends of groove 21 as it might otherwise do is caught behind one of finger-like members 50. Finger-like members 50, as shown, may be either the finger-like members comprising portions 30, 31, 32 and 33 or the finger-like members comprising portions 34, 35, 36 and 37.

When user 42's arms are lifted to a position such as shown in dashed lines in FIG. 4 (at 49') or in FIG. 14 the bar as may be seen is tilted in the opposite direction so that cable 24 is caught by the other one of finger-like members 50.

Figure 5:
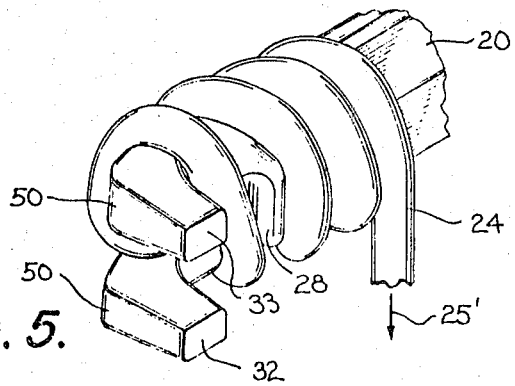
FIG. 5 is a fragmentary perspective view of one end of the bar showing an elastic cable received in the groove of the bar and wound therearound in response to rotation of the bar.

The effective length of each of runs 25 of cable 24 may be reduced by further rotating the bar so that cable 24 having been caught behind one of finger-like members 50 is wound several times around the end of bar 20 as shown for one end of the bar in FIG. 5, the run of the cable from one end of the bar being indicated in this instance by the arrow 25'.

Referring now to FIG. 8 there is shown an embodiment wherein bar 20' is an extruded member of aluminum or polymeric synthetic resinous material having three hollow portions 59 and a groove 21' which is let into the upper surface of bar 20' but differs from groove 21 in that it does not have rounded ends as at points 26 and 27 in FIG. 1.

Referring now to FIG. 9 there is shown an embodiment wherein bar 20" is provided with a groove 21 which may be identical with groove 21 of the embodiment of FIG. 1. Extending from each end of the bar alongside the edges of the groove there may be provided finger-like members 60 which differ from members 50 in that they extend straight out longitudinally and are neither turned down nor turned up at the ends.

Referring now to FIG. 10, bar 20" is shown in a position in which groove 21 opens upwardly, cable 24 being received in the groove and a run of cable 25 being extended downwardly from the end of the bar as shown. When bar 20" is rotated as shown in FIG. 11, cable 24 is caught by the lowermost of finger-like members 60 and thus prevented from coming out of groove 21.

When bar 20" is rotated still further as shown in FIG. 12, the effect of the aforementioned one of finger-like members 50 has become more pronounced in its action in retaining cable 24 in attached relationship to the bar and within groove 21.

When bar 20'' is rotated still further as shown in FIG. 13, the manner in which cable 24 continues to be retained within groove 21 and thereby in attached relationship to the bar is more clearly shown. Also shown in FIG. 13 is the manner in which cable 24 thus begins to be wound around the bar whereby, by continued rotation of the bar, several windings of the cable around the bar can be provided as shown in FIG. 5.

Referring now to FIG. 15, it may be seen that bar 20''' may be provided having a groove 21 corresponding to grooves 21 previously described and having finger-like members 70 which extend longitudinally outward on each side of the groove at each end of the bar (only one end being shown) and then instead of extending downwardly as described for the bar of FIGS. 1 to 5 instead extend upwardly as indicated at 71. Finger-like members 70 function in the same manner as described hereinbefore for finger-like members 50 and 60.

Referring now to FIG. 16, bar 20'''' may be provided with a groove 21 which may be identical to groove 21 described in connection with previous embodiments and may be provided with finger-like members 80 extending outward from each end, only one end being shown, respectively alongside each side of groove 21. Finger-like members 80 may however extend divergently longitudinally outward instead of extending parallelly longitudinally outward as described for finger-like members 60. Finger-like members 80 are shown as being turned neither upwardly nor downwardly near their ends but if desired they could be turned either upwardly as described for finger-like members 70 or downwardly as described for finger-like members 50.

Referring to FIGS. 17 and 18, bar 20''''' is similar in configuration to that of bar 20 of FIGS. 1-5 and 14, but is jointed to be separable into sections 90 and 91, the sections being of approximately equal length as shown. If desired, the bar could be segmented into a greater number of sections. Section 90 as shown is provided with projecting pins 92, 93, received, as best shown in FIG. 18, in sleeves 100,101 disposed in blind holes 94,95 in section 91, the sleeves and the pins preferably being fixedly secured in their bar sections by press-fitting or equivalent means. Each of pins 92 and 93 is provided with a detent 96 comprising as shown in FIG. 18, ball 98 and loading spring 99 disposed within recess 97 in operable manner for retaining and resiliently urging ball 98 to radially project through the projected interface of the sleeve and the pin and beyond the innermost extremity of sleeves 100, 101 within holes 94, 95. Pins 92, 93 are inserted in sleeves 100, 101 until the end faces of bar sections 90, 91 are tightly abutting, in which position balls 98 of detents 96 project beyond the end of sleeves 100, 101 lip-like to operably secure the bar sections in tight contact. The sections may be separated only by manually pulling the bar sections apart longitudinally.

Groove 21' of bar 20''''' is tapered in depth from relatively more shallow depression at faces 102, 103, to relatively greater depression similar to that shown for groove 21 in FIGS. 2 and 3 at the ends of bar 20'''''. Tapering the depth of groove 21 provides greater cross-sectional area for placement of pins 92, 93 and sleeves 100, 101 and enables such means to be disposed nearer the upper most portion of the bar than would be possible if the groove were not tapered, the combination of pin and sleeve placement high in the bar and increased cross-sectional area of the bar at the joint being effective to provide optimum strength and resistance to bending flexure of the bar and to separation of the bar sections at the joint. While bar 20''''' is of equivalent or greater strength than bar 20 of similar dimension, bar 20''''' may be more conveniently transported and stored by disassembling the two sections, 90, and 91, one from the other so that the entire exercise device may be conveniently packed in a valise or overnight case.

It will be apparent to those skilled in the art that equivalents may be utilized. Accordingly, the present invention may be embodied in other specific forms without departing from the spirit of essential attributes thereof and accordingly reference should be made to the appended claims rather than to the foregoing specification as indicating the scope of the invention.

I claim:

1. In exercise apparatus having an elastic cable for being attached to a laterally extending bar and providing downwardly extending runs of cable at each end, an improvement comprising pieces shorter in length than said bar joined to be separable and end-abutting to provide an assembled bar of lever-like rigidity and elongated configuration for being gripped by both hands of a user and having a longitudinally grooved upper surface for receiving said cable between points of terminal contact of said cable with said bar, and having bifurcated ends formed by finger-like members which extend from the two opposite sides to beyond the ends of said groove, said bifurcated ends being adapted to receive downward runs of cable therein and to receive convolutions of said cable thereon upon rotation of said bar with said cable engaged thereon, said pieces being coupled by locking pins and a pair of sleeves, each sleeve of said pair of sleeves being anchored in one of the two said pieces disposed to be end abutting, said locking pin embodying a detent which comprises means for being resiliently biased transversely to the axial direction of the locking pin and urged beyond the projected interface of said locking pin and an associated sleeve to maintain said pieces firmly abutting during exercise use of said bar and enabling manual disassembly of said bar to provide said pieces severally for rendering said exercise apparatus compactly transportable.

2. The device of claim 1 wherein said detent comprises substantially spherical means retained in said locking pin for being biased by resilient spring means embodied in said locking pin.

3. The device of claim 1 wherein each face abutting end of said pieces is provided with multiple number of said member anchored therein, thereby increasing holding strength of said members and resistance to inadvertent displacement of said pieces, one to the other.

4. The device of claim 1 wherein said detent is disposed to bias said means beyond the inward most end extremity of an associated sleeve.

* * * * *